US006740829B1

(12) United States Patent
Wong

(10) Patent No.: US 6,740,829 B1
(45) Date of Patent: May 25, 2004

(54) INSERTION-TYPE LIQUID METAL LATCHING RELAY

(75) Inventor: Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/412,824

(22) Filed: Apr. 14, 2003

(51) Int. Cl.[7] ..... H01H 29/02
(52) U.S. Cl. ..... 200/214; 200/182
(58) Field of Search ..... 200/214, 182, 200/190, 193, 234, 199; 307/409

(56) References Cited

U.S. PATENT DOCUMENTS

| | | | | |
|---|---|---|---|---|
| 2,312,672 A | * | 3/1943 | Pollard, Jr. | 335/58 |
| 2,564,081 A | * | 8/1951 | Schilling | 335/56 |
| 3,430,020 A | | 2/1969 | Von Tomkewitsch et al. | |
| 3,529,268 A | * | 9/1970 | Rauterberg | 335/56 |
| 3,600,537 A | | 8/1971 | Twyford | |
| 3,639,165 A | | 2/1972 | Rairden, III | |
| 3,657,647 A | * | 4/1972 | Beusman et al. | 324/94 |
| 4,103,135 A | | 7/1978 | Gomez et al. | |
| 4,200,779 A | | 4/1980 | Zakurdaev et al. | |
| 4,245,886 A | | 1/1981 | Kolodzey et al. | |
| 4,336,570 A | | 6/1982 | Brower | |
| 4,419,650 A | | 12/1983 | John | |
| 4,434,337 A | * | 2/1984 | Becker | 200/220 |
| 4,475,033 A | | 10/1984 | Willemsen et al. | |
| 4,505,539 A | | 3/1985 | Auracher et al. | |
| 4,582,391 A | | 4/1986 | Legrand | |
| 4,628,161 A | | 12/1986 | Thackrey | |
| 4,652,710 A | | 3/1987 | Karnowsky et al. | |

(List continued on next page.)

FOREIGN PATENT DOCUMENTS

| | | | |
|---|---|---|---|
| EP | 0593836 A1 | | 4/1994 |
| FR | 2418539 | | 9/1979 |
| FR | 2458138 | | 12/1980 |
| FR | 2667396 | | 4/1992 |
| JP | SHO 36-18575 | | 10/1961 |
| JP | SHO 47-21645 | | 10/1972 |
| JP | 3276838 | * | 5/1987 |
| JP | 1294317 | * | 5/1988 |
| JP | 8-125487 | | 5/1996 |
| JP | 9161640 | | 6/1997 |
| WO | WO99/46624 | | 12/1999 |

OTHER PUBLICATIONS

TDB–ACC–NO:NB8406827, "Integral Power Resistors For Aluminum Substrate", IBM Technical Disclosure Bulletin, Jun. 1984, US, vol. 27, Issue No. 1B, p. 827.

Bhedwar, Homi C., et al, "Ceramic Multilayer Package Fabrication." Electronic Materials Handbook, Nov. 1989, pp 460–469, vol. 1 Packaging, Section 4; Packages.

Kim, Joonwon, et al., "A Micromechanical Switch With Electrostatically Driven Liquid–Metal Droplet." Sensors and Actuators, A: Physical. v 9798, Apr. 1, 2002, 4 pages.

Jonathan Simon, "A Liquid–Filled Microrelay With A Moving Mercury Microdrop" (Sep. 1997), Journal of Microelectromechinical Systems, vol. 6, No. 3, pp 208–216.

Marvin Glenn Wong, "A Piezoelectrically Actuated Liquid Metal Switch", May 2, 2000, patent application (pending, 12 pages of specification, 5 pages of claims, 1 page of abstract, and 10 sheets of drawings (Figs. 1–10).

*Primary Examiner*—Lincoln Donovan
*Assistant Examiner*—Lisa Klaus

(57) ABSTRACT

A high frequency electrical relay uses a conducting liquid in the switching mechanism. The relay uses an actuator, such as a piezoelectric element, to cause the switch actuator to insert into a cavity in a static switch contact structure. The cavity has sides and a pad on its end that are wettable by the conducting liquid. The cavity is filled with the conducting liquid, which may be liquid metal. The volume of conducting liquid is chosen so that when the actuator returns to its rest position, the electrical contact is maintained by surface tension and by wetting of the contact pads on both the static switch contact structure and the actuator.

16 Claims, 5 Drawing Sheets

U.S. PATENT DOCUMENTS 4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A * 5/1998 Prior et al. ..... 307/118
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 * 1/2001 Bitko ..... 174/9 F
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 11/2001 Kondoh et al.
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

* cited by examiner-

INSERTION-TYPE LIQUID METAL LATCHING RELAY

CROSS REFERENCE TO RELATED APPLICATIONS

This application is related to the following co-pending U.S. Patent Applications, being identified by the below enumerated identifiers and arranged in alphanumerical order, which have the same ownership as the present application and to that extent are related to the present application and which are hereby incorporated by reference:

application No. 10010448-1, titled "Piezoelectrically Actuated Liquid Metal Switch", filed May 2, 2002 and identified by Ser. No. 10/137,691;

application No. 10010529-1, titled "Bending Mode Latching Relay", having the same filing date as the present application and identified by Ser. No. 10/413,068;

application No. 10010531-1, titled "High Frequency Bending Mode Latching Relay", having the same filing date as the present application and identified by Ser. No. 10/412,912;

application No. 10010570-1, titled "Piezoelectrically Actuated Liquid Metal Switch", filed May 2, 2002 and identified by Ser. No. 10/142,076;

application No. 10010571-1, titled "High-frequency, Liquid Metal, Latching Relay with Face Contact", having the same filing date as the present application and identified by Ser. No. 10/412,991;

application No. 10010572-1, titled "Liquid Metal, Latching Relay with Face Contact", having the same filing date as the present application and identified by Ser. No. 10/413,195;

application No. 10010617-1, titled "High-frequency, Liquid Metal, Latching Relay Array", having the same filing date as the present application and identified by Ser. No. 10/413,278;

application No. 10010618-1, titled "Insertion Type Liquid Metal Latching Relay Array", having the same filing date as the present application and identified by Ser. No. 10/412,880;

application No. 10010634-1, titled "Liquid Metal Optical Relay", having the same filing date as the present application and identified by Ser. No. 10/413,267;

application No. 10010640-1, titled "A Longitudinal Piezoelectric Optical Latching Relay", filed Oct. 31, 2001 and identified by Ser. No. 09/999,590;

application No. 10010643-1, titled "Shear Mode Liquid Metal Switch", having the same filing date as the present application and identified by Ser. No. 10/413,314;

application 10010644-1, titled "Bending Mode Liquid Metal Switch", having the same filing date as the present application and identified by Ser. No. 10/413,328;

application No. 10010656-1, titled "A Longitudinal Mode Optical Latching Relay", having the same filing date as the present application and identified by Ser. No. 10/413,215;

application No. 10010663-1, titled "Method and Structure for a Pusher-Mode Piezoelectrically Actuated Liquid Metal Switch", having the same filing date as the present application and identified by Ser. No. 10/413,098;

application No. 10010664-1, titled "Method and Structure for a Pusher-Mode Piezoelectrically Actuated Liquid Metal Optical Switch", having the same filing date as the present application and identified by Ser. No. 10/412,895;

application No. 10010790-1, titled "Switch and Production Thereof", filed Dec. 12, 2002 and identified by Ser. No. 10/317,597;

application No. 10011055-1, titled "High Frequency Latching Relay with Bending Switch Bar", having the same filing date as the present application and identified by Ser. No. 10/413,237;

application No. 10011056-1, titled "Latching Relay with Switch Bar", having the same filing date as the present application and identified by Ser. No. 10/413,099;

application No. 10011064-1, titled "High Frequency Push-mode Latching Relay", having the same filing date as the present application and identified by Ser. No. 10/413,100;

application No. 10011065-1, titled "Push-mode Latching Relay", having the same filing date as the present application and identified by Ser. No. 10/413,067;

application No. 10011121-1, titled "Closed Loop Piezoelectric Pump", having the same filing date as the present application and identified by Ser. No. 10/412,857;

application No. 10011329-1, titled "Solid Slug Longitudinal Piezoelectric Latching Relay", filed May 2, 2002 and identified by Ser. No. 10/137,692;

application No. 10011344-1, titled "Method and Structure for a Slug Pusher-Mode Piezoelectrically Actuated Liquid Metal Switch", having the same filing date as the present application and identified by Ser. No. 10/412,869;

application No. 10011345-1, titled "Method and Structure for a Slug Assisted Longitudinal Piezoelectrically Actuated Liquid Metal Optical Switch", having the same filing date as the present application and identified by Ser. No. 10/412,916;

application No. 10011397-1, titled "Method and Structure for a Slug Assisted Pusher-Mode Piezoelectrically Actuated Liquid Metal Optical Switch", having the same filing date as the present application and identified by Ser. No. 10/413,070;

application No. 10011398-1, titled "Polymeric Liquid Metal Switch", having the same filing date as the present application and identified by Ser. No. 10/413,094;

application No. 10011410-1, titled "Polymeric Liquid Metal Optical Switch", having the same filing date as the present application and identified by Ser. No. 10/412,859;

application No. 10011436-1, titled "Longitudinal Electromagnetic Latching Optical Relay", having the same filing date as the present application and identified by Ser. No. 10/412,868;

application No. 10011437-1, titled "Longitudinal Electromagnetic Latching Relay", having the same filing date as the present application and identified by Ser. No. 10/413,329;

application No. 10011458-1, titled "Damped Longitudinal Mode Optical Latching Relay", having the same filing date as the present application and identified by Ser. No. 10/412,894;

application No. 10011459-1, titled "Damped Longitudinal Mode Latching Relay", having the same filing date as the present application and identified by Ser. No. 10/412,914;

application No. 10020013-1, titled "Switch and Method for Producing the Same", filed Dec. 12, 2002 and identified by Ser. No. 10/317,963;

application No. 10020027-1, titled "Piezoelectric Optical Relay", filed Mar. 28, 2002 and identified by Ser. No. 10/109,309;

application No. 10020071-1, titled "Electrically Isolated Liquid Metal Micro-Switches for Integrally Shielded Microcircuits", filed Oct. 8, 2002 and identified by Ser. No. 10/266,872;

application No. 10020073-1, titled "Piezoelectric Optical Demultiplexing Switch", filed Apr. 10, 2002 and identified by Ser. No. 10/119,503;

application No. 10020162-1, titled "Volume Adjustment Apparatus and Method for Use", filed Dec. 12, 2002 and identified by Ser. No. 10/317,293;

application No. 10020231-1, titled "Ceramic Channel Plate for a Switch", filed Dec. 12, 2002 and identified by Ser. No. 10/317,960:

application No. 10020241-1, titled "Method and Apparatus for Maintaining a Liquid Metal Switch in a Ready-to-Switch Condition", having the same filing date as the present application and identified by Ser. No. 10/413,002;

application No. 10020242-1, titled "A Longitudinal Mode Solid Slug Optical Latching Relay", and having the same filing date as the present application;

application No. 10020473-1, titled "Reflecting Wedge Optical Wavelength Multiplexer/Demultiplexer", having the same filing date as the present application and identified by Ser. No. 10/413,270;

application No. 10020540-1, titled "Method and Structure for a Solid Slug Caterpillar Piezoelectric Relay", having the same filing date as the present application and identified by Ser. No. 10/413,088;

application No. 10020541-1, titled "Method and Structure for a Solid Slug Caterpillar Piezoelectric Optical Relay", having the same filing date as the present application and identified by Ser. No. 10/413,196;

application No. 10020698-1, titled "Laser Cut Channel Plate for a Switch", filed on Dec. 12, 2002 and identified by Ser. No. 10/317,932;

application No. 10030438-1, titled "Inserting-finger Liquid Metal Relay", having the same filing date as the present application and identified by Ser. No. 10/413,187;

application No. 10030440-1, titled "Wetting Finger Liquid Metal Latching Relay", having the same filing date as the present application and identified by Ser. No. 10/413,058;

application No. 10030521-1, titled "Pressure Actuated Optical Latching Relay", having the same filing date as the present application and identified by Ser. No. 10/412,874;

application No. 10030522-1, titled "Pressure Actuated Solid Slug Optical Latching Relay", having the same filing date as the present application and identified by Ser. No. 10/413,162; and application No. 10030546-1, titled "Method and Structure for a Slug Caterpillar Piezoelectric Reflective Optical Relay", having the same filing date as the present application and identified by Ser. No. 10/412,910.

FIELD OF THE INVENTION

The invention relates to the field of micro-electromechanical systems (MEMS) for electrical switching, and in particular to a high frequency piezoelectrically actuated latching relay with liquid metal contacts.

BACKGROUND OF THE INVENTION

Liquid metals, such as mercury, have been used in electrical switches to provide an electrical path between two conductors. An example is a mercury thermostat switch, in which a bimetal strip coil reacts to temperature and alters the angle of an elongated cavity containing mercury. The mercury in the cavity forms a single droplet due to high surface tension. Gravity moves the mercury droplet to the end of the cavity containing electrical contacts or to the other end, depending upon the angle of the cavity. In a manual liquid metal switch, a permanent magnet is used to move a mercury droplet in a cavity.

Liquid metal is also used in relays. A liquid metal droplet can be moved by a variety of techniques, including electrostatic forces, variable geometry due to thermal expansion/contraction and magneto-hydrodynamic forces.

Conventional piezoelectric relays either do not latch or use residual charges in the piezoelectric material to latch or else activate a switch that contacts a latching mechanism.

Rapid switching of high currents is used in a large variety of devices, but provides a problem for solid-contact based relays because of arcing when current flow is disrupted. The arcing causes damage to the contacts and degrades their conductivity due to pitting of the electrode surfaces.

Micro-switches have been developed that use liquid metal as the switching element and the expansion of a gas when heated to move the liquid metal and actuate the switching function. Liquid metal has some advantages over other micro-machined technologies, such as the ability to switch relatively high powers (about 100 mW) using metal-to-metal contacts without micro-welding or overheating the switch mechanism. However, the use of heated gas has several disadvantages. It requires a relatively large amount of energy to change the state of the switch, and the heat generated by switching must be dissipated effectively if the switching duty cycle is high. In addition, the actuation rate is relatively slow, the maximum rate being limited to a few hundred Hertz.

SUMMARY

A high frequency electrical relay is disclosed that uses a conducting liquid in the switching mechanism. The relay uses an actuator, such as a piezoelectric element, to cause the switch actuator to insert into a cavity in a static switch contact structure. The cavity has sides and a pad on its end that are wettable by the conducting liquid. The cavity is filled with the conducting liquid, which may be liquid metal. Insertion of the switch actuator into the cavity causes the conducting liquid to be displaced outward and come in contact with the contact pad on the switch actuator. The volume of conducting liquid is chosen so that when the actuator returns to its rest position, the electrical contact is maintained by surface tension and by wetting of the contact pads on both the static switch contact structure and the actuator. When the switch actuator retracts away from the static switch contact structure, the available volume for conducting liquid inside the fixed switch contact structure increases and the combination of the movement of the conducting liquid into the cavity and the contact pad on the switch actuator moving away from the bulk of the conducting liquid causes the conducting liquid connection between the fixed and moving contact pads to be broken. When the switch actuator returns to its rest position, the contact remains electrically open because there is not enough conducting liquid to bridge the gap without being disturbed. The high frequency capability is provided by the additional conductors in the assembly, which act to make the switch a coaxial structure. The relay is amenable to manufacture by micro-machining techniques.

BRIEF DESCRIPTION OF THE DRAWINGS

The features of the invention believed to be novel are set forth with particularity in the appended claims. The invention itself however, both as to organization and method of operation, together with objects and advantages thereof, may be best understood by reference to the following detailed description of the invention, which describes certain exemplary embodiments of the invention, taken in conjunction with the accompanying drawings in which:

DETAILED DESCRIPTION

Figure 1:
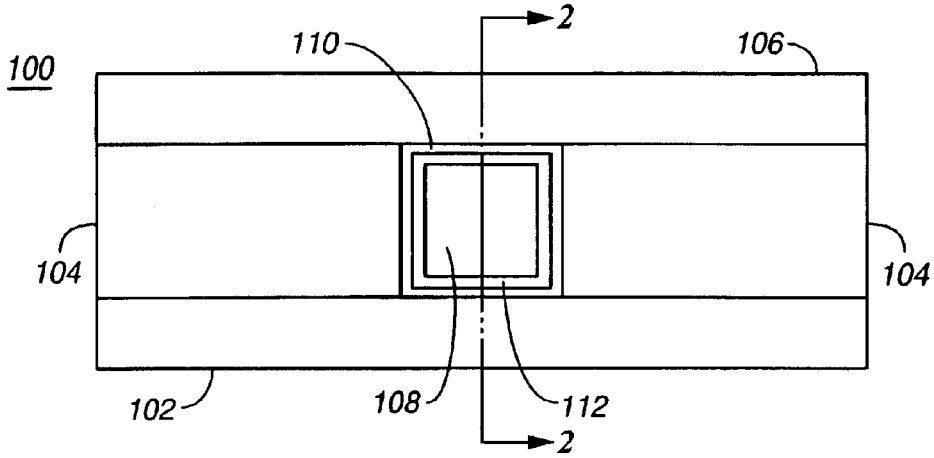
FIG. 1 is an end view of a latching relay in accordance with certain embodiments of the present invention.

While this invention is susceptible of embodiment in many different forms, there is shown in the drawings and will herein be described in detail one or more specific embodiments, with the understanding that the present disclosure is to be considered as exemplary of the principles of the invention and not intended to limit the invention to the specific embodiments shown and described. In the description below, like reference numerals are used to describe the same, similar or corresponding parts in the several views of the drawings.

The electrical relay of the present invention uses a conducting liquid, such as liquid metal, to bridge the gap between two electrical contacts and thereby complete an electrical circuit between the contacts. The relay uses an actuator, such as a piezoelectric element, to cause the switch actuator to insert into a cavity in a fixed switch contact structure. The cavity has sides and a pad on its end that are wettable by the conducting liquid. The cavity is filled with the conducting liquid. Insertion of the actuator into the cavity causes the conducting liquid to be displaced outward and come in contact with the contact pad on the actuator. The volume of conducting liquid is chosen so that when the actuator returns to its rest position, the electrical contact is maintained by surface tension and by wetting of the contact pads on both the static switch contact structure and the actuator. When the switch actuator retracts away from the static switch contact structure, the available volume for conducting liquid inside the fixed switch contact structure increases and the combination of the movement of the conducting liquid into the cavity and the contact pad on the switch actuator moving away from the bulk of the conducting liquid causes the conducting liquid connection between the fixed and moving contact pads to be broken. When the switch actuator returns to its rest position, the contact remains electrically open because there is not enough conducting liquid to bridge the gap without being disturbed. A high frequency capability is provided by the additional conductors in the assembly, which act to make the switch a coaxial structure.

In an exemplary embodiment, the conducting liquid is a preferably liquid metal, such as mercury, with high conductivity, low volatility and high surface tension. The actuator is preferably a piezoelectric actuator, but other actuators, such as magnetostrictive actuators, may be used. In the sequel, piezoelectric and magnetorestrictive will be collectively referred to as "piezoelectric".

FIG. 1 is a view of an embodiment of a latching relay of the present invention. Referring to FIG. 1, the relay 100 comprises three layers: a circuit layer 102, a switching layer 104 and a cap layer 106. The circuit layer 102 supports electrical connections to the elements in the switching layer and provides a lower cap to the switching layer. The circuit layer 102 may be made of a ceramic or silicon, for example, and is amenable to manufacture by micro-machining techniques, such as those used in the manufacture of microelectronic devices. The switching layer 104 may be made of ceramic or glass, for example, or may be made of metal coated with an insulating layer (such as a ceramic). A channel passes through the switching layer. At one end of the channel in the switching layer is a signal conductor 108 that is electrically coupled to one of the switch contacts of the relay. Optionally, a ground conductor 110 encircles the switching elements. The signal conductor 108 is electrically isolated from the ground conductor by a dielectric layer 112 that surrounds the signal conductor. In an exemplary embodiment, the ground conductor 110 is formed, in part, from traces deposited on the upper side of the circuit substrate and on the under side of the cap layer 106. The rest of the ground conductor is fixed to the substrate of the switching layer. The cap layer 106 covers and seals the top of the switching layer 104. The cap layer 106 may be made of ceramic, glass, metal or polymer, for example, or combinations of these materials. Glass, ceramic or metal is preferably used to provide a hermetic seal.

Figure 2:
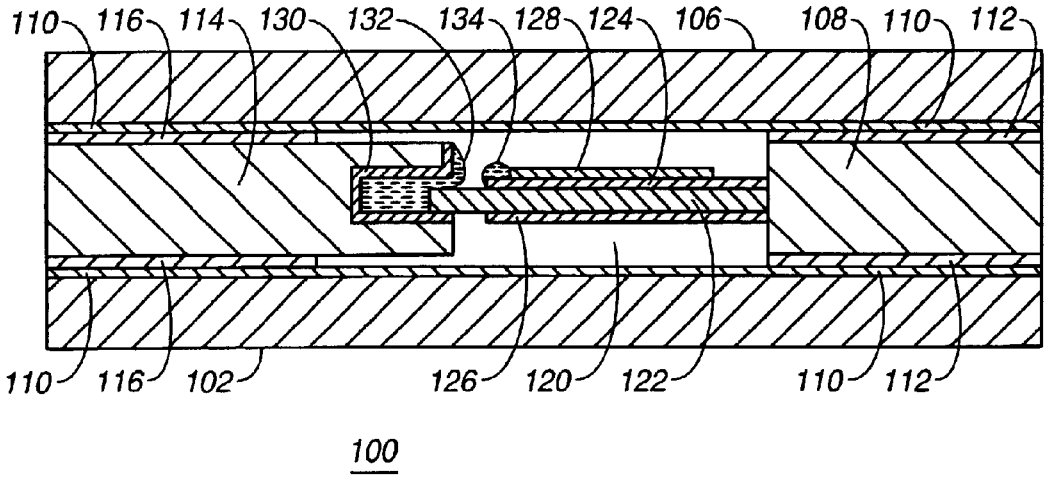
FIG. 2 is a sectional view of a latching relay in an open switch state in accordance with certain embodiments of the present invention.

FIG. 2 is a sectional view of an embodiment of a latching relay 100 of the present invention. The section is denoted by 2—2 in FIG. 1. Referring to FIG. 2, the switching layer incorporates a switching cavity 120. The cavity may be filled with an inert gas. A signal conductor 114 occupies one end of the channel through the switching layer. The signal conductor 114 is electrically isolated from the ground conductor 110 by dielectric layer 116. A fixed electrical contact 130 is attached to the end of the signal conductor. Part of the fixed electrical contact 130 is concave and lines a cavity in the end of signal conductor 114. Another part forms a pad covering part of the interior end of the signal conductor 114. One end of actuator 122 is attached to the signal conductor 108, while the other end projects into the concave part of the fixed contact 130. A moveable electrical contact 124 is attached to the actuator. In operation, the length of the actuator 122 is increased or decreased to move the moveable electrical contact 124 towards or away from the fixed electrical contact 130. In an exemplary embodiment, the actuator preferably includes a piezoelectric actuator. The moveable contact 124 may formed as a conductive coating on the actuator, in which case contact 126 is a continuation of the contact 124. Alternatively, the contact 124 may be positioned on one side of the actuator and the contact 126 positioned on the other side to reduce bending of the actuator. In a further embodiment, the contact 126 is omitted. The surfaces of the static and moveable electrical contacts are wettable by a conducting liquid. In operation, the moveable contact 124 supports a droplet of conducting liquid 134 that is held in place by the surface tension of the liquid. Due to the small size of the droplet 134, the surface tension dominates any body forces on the droplets and so the droplet is held in place. The concave portion of the fixed contact 130 creates a liquid well that is filled with conducting liquid 132. The liquid 132 also wets the pad portion of the contact 130. The moveable contact 124 is partially coated with non-wetting coatings 128 to prevent migration of the conducting liquid along the contact. Signal conductor 108 is electrically insulated from the ground conductor 110 by dielectric layer 112, while signal conductor 114 is electrically insulated from the ground conductor 110 by dielectric layer 116.

Figure 3:
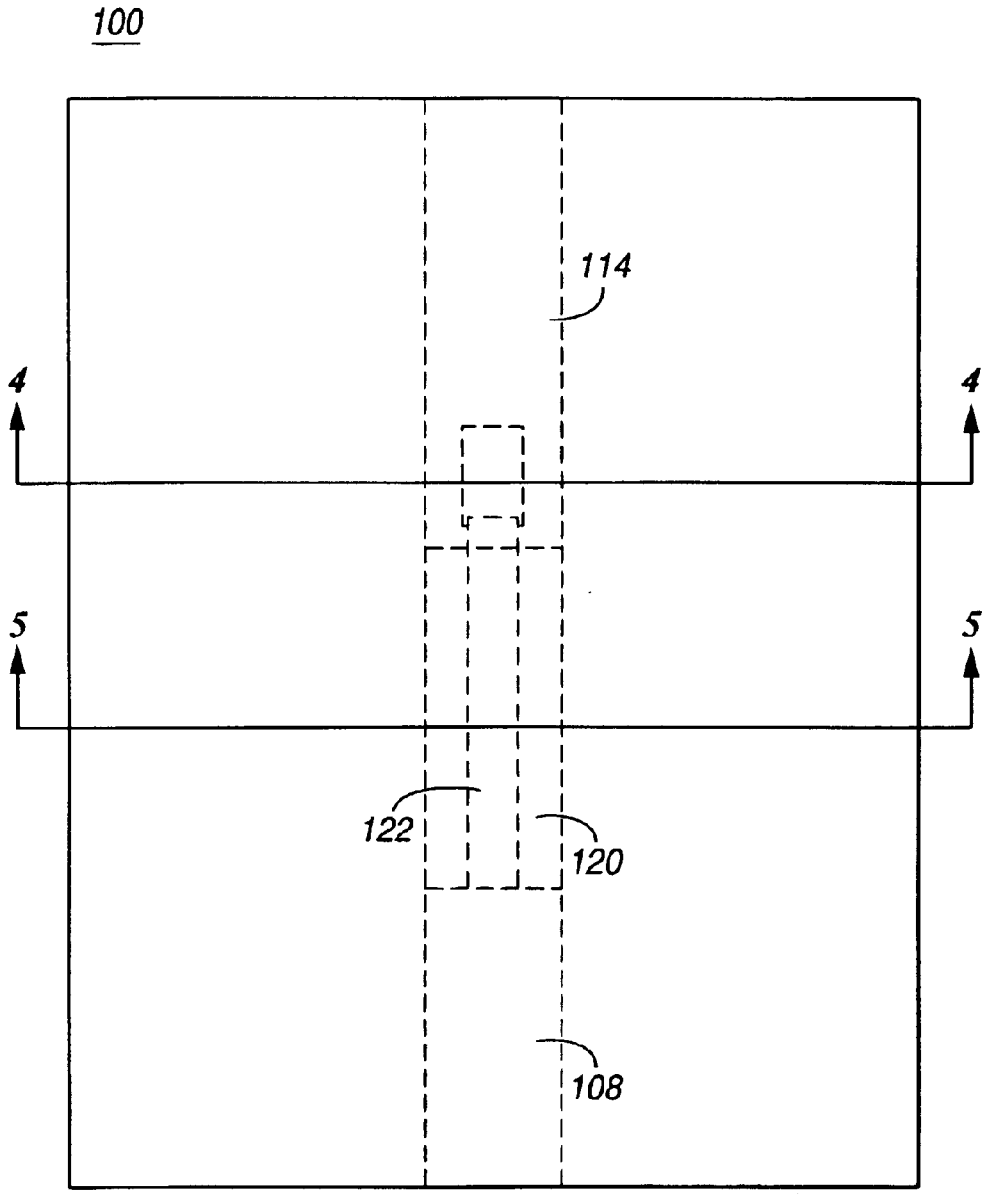
FIG. 3 is a top view of a latching relay in accordance with certain embodiments of the present invention.

FIG. 3 is a top view of a latching relay 100. The broken lines indicate hidden structure. 114 and 108 are signal conductors. 122 is the piezoelectric actuator in switching cavity 120. The sections 4—4 and 5—5 are shown in FIGS. 4 and 5 respectively.

Figure 4:
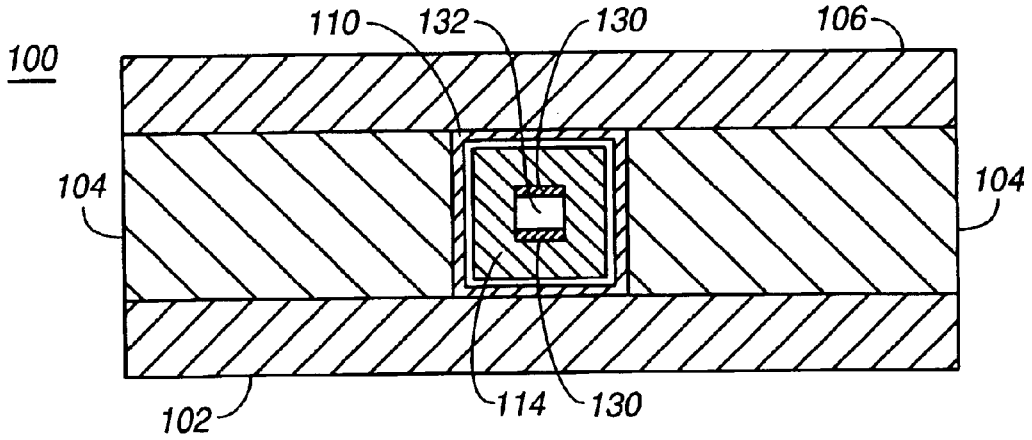
FIG. 4 is a further sectional view of a latching relay in accordance with certain embodiments of the present invention.

FIG. 4 is a sectional view through section 4—4 of the latching relay shown in FIG. 3. The view shows the three layers: the circuit layer 102, the switching layer 104 and the cap layer 106. The static contact 130 lines the inside of a cavity in the signal conductor 114 and forms a liquid well. Conducting liquid 132 is contained within the liquid well and is held in place by surface tension. The ground conductor 110 surrounds the signal conductor 114 and static contact 130. This facilitates switching high frequency signals by the relay.

Figure 5:
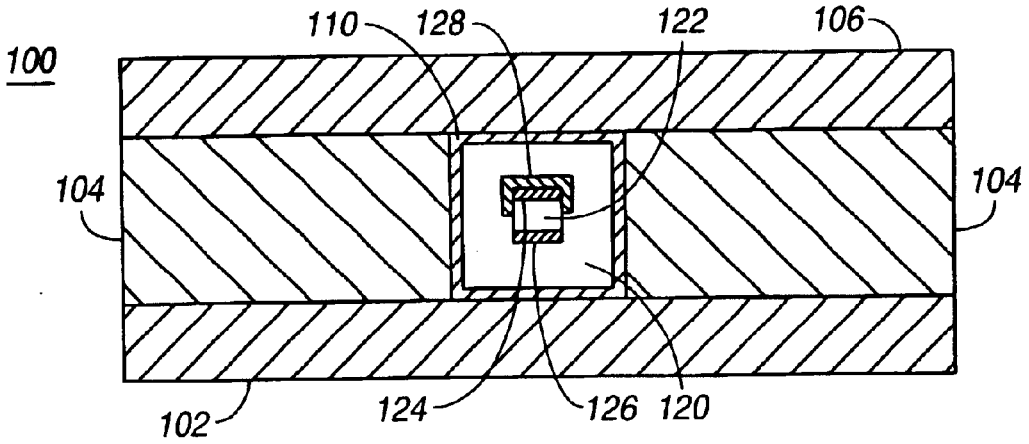
FIG. 5 is a further sectional view of a latching relay in accordance with certain embodiments of the present invention.

FIG. 5 is a sectional view through section 5—5 of the latching relay shown in FIG. 3. The view shows the three layers: the circuit layer 102, the switching layer 104 and the cap layer 106. The actuator 122 is positioned within the switching cavity 120. The switching cavity 120 is sealed below by the circuit layer 102 and sealed above by the cap layer 106. The ground conductor 110 surrounds the actuator 122 and moveable contact 124. This facilitates high frequency switching of the relay. The non-wetting coating 128 covers the moveable contact 124 and prevents migration of the conducting liquid along the contact.

Figure 6:
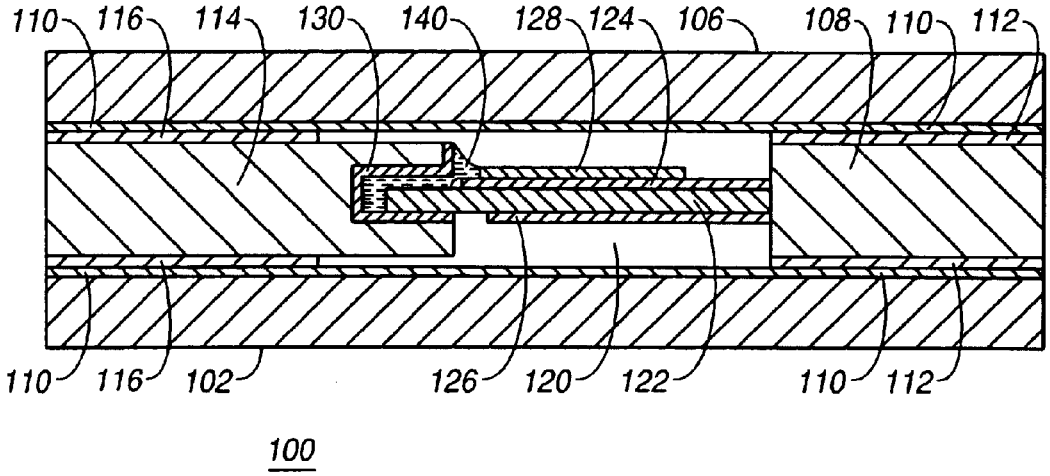
FIG. 6 is a sectional view of a latching relay in a closed switch state in accordance with certain embodiments of the present invention.

The electrical circuit through the relay is completed by energizing the actuator to cause it to extend into the well of conducting fluid as shown in the sectional view in FIG. 6. Referring to FIG. 6, the actuator 122 extends into the liquid well of conducting liquid contained in the concave part of the static contact 130. At the same time, the moveable contact 124 is brought closer the static contact. The insertion of the actuator into the well forces some of the conducting liquid out of the well and causes it to bridge the gap between the static contact 130 and the moveable contact 124. This forms a single volume of conducting liquid 140. The conducting liquid 140 completes the electrical circuit between the signal conductors 108 and 114.

Figure 7:
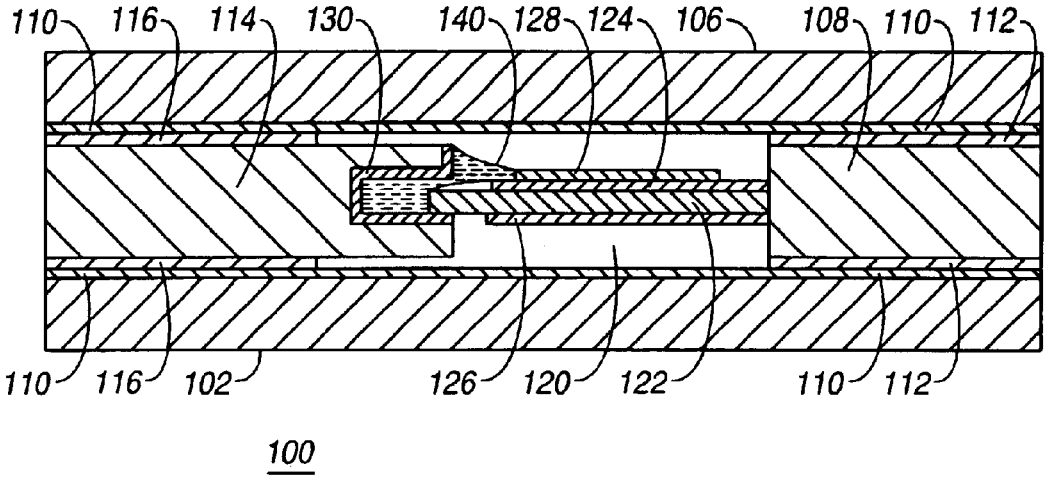
FIG. 7 is a sectional view of a latching relay in a closed and latched switch state in accordance with certain embodiments of the present invention.

Once the circuit is complete, the actuator 122 is de-energized and withdraws from the well. The volume of the conducting liquid and the spacing between the contacts are such that the conducting liquid continues to bridge the gap between the contacts as shown in FIG. 7. The electrical circuit between the contacts remains complete, so the relay is latched.

To break the electrical circuit between the contacts, the actuator is energized in the reverse direction so that its length decreases. The actuator withdraws from the liquid well and the moveable contact is moved farther away from the static contact. Conducting liquid is drawn back into the well. The surface tension bond is insufficient to hold the conducting liquid in a single volume, so the liquid separates into two volumes. In the manner, the electrical circuit is broken. When the actuator is again de-energized, there is insufficient liquid to bridge the gap, so the circuit remains open as shown in FIG. 2.

In a further embodiment, both electrical contacts are fixed and the actuator operates to displace conducting liquid from a liquid well such that it bridges the gap between the electrical contacts.

Although an actuator operating in an extension mode has been described, other modes of operation that result in a change in the volume of the actuator may be used.

The use of mercury or other liquid metal with high surface tension to form a flexible, non-contacting electrical connection results in a relay with high current capacity that avoids pitting and oxide buildup caused by local heating. The ground conductor provides a shield surrounding the signal path, facilitating high frequency switching.

Figure 8:
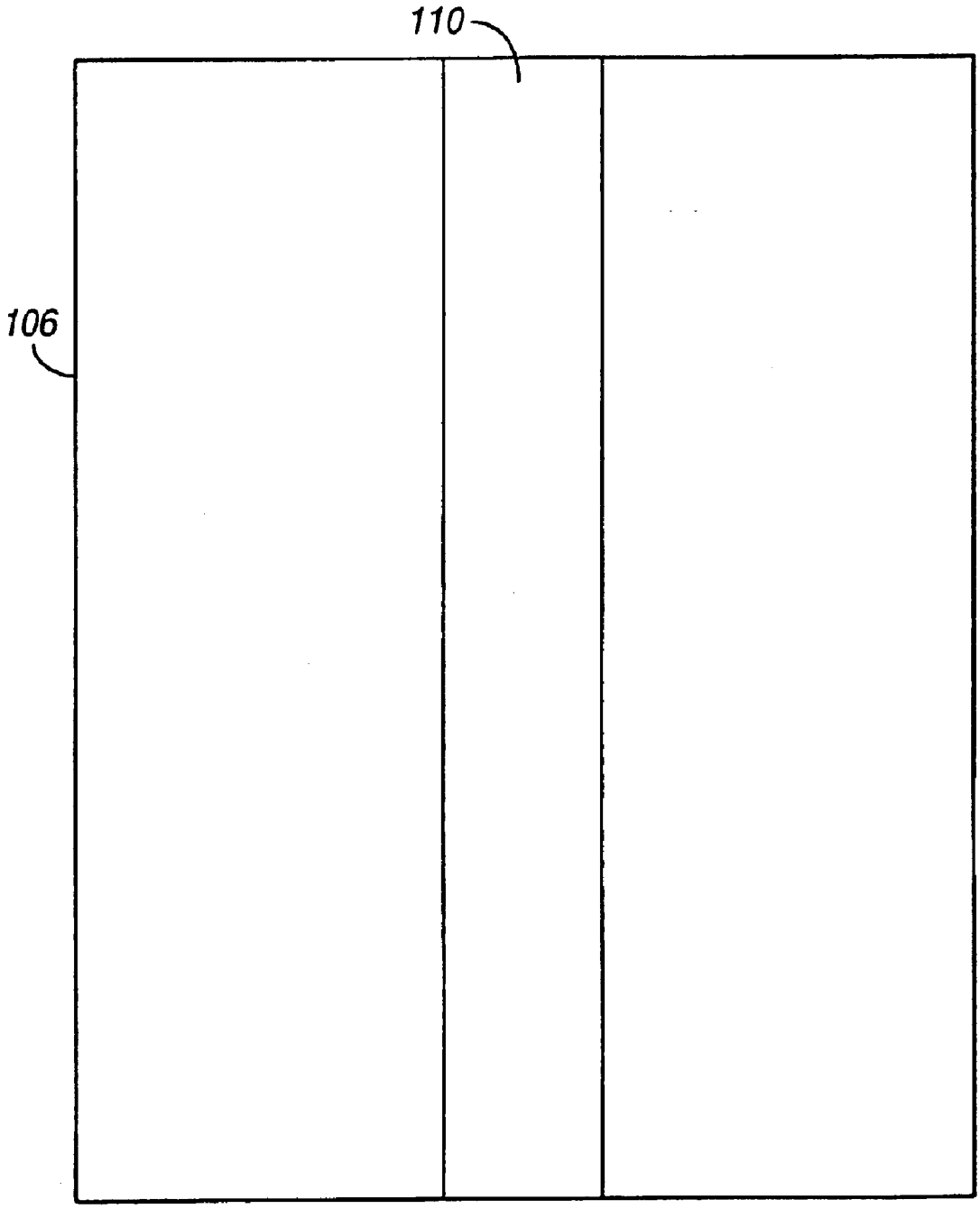
FIG. 8 is a view of a cap layer of a latching relay in accordance with certain embodiments of the present invention.

FIG. 8 is a view of the inside surface of the cap layer 106. The cap layer 106 provides a seal for the channel in the switching layer. A ground trace 142 is deposited on the surface of the cap layer, and forms one side of the ground conductor (110 in FIG. 1) that is coaxial with the signal conductors and switching mechanism. A similar ground trace is deposited on the inner surface of the circuit layer.

In an exemplary embodiment, the static contact structure, the conductive coating on the actuator, and the signal conductors preferably have similar outer dimensions for best electrical performance so as to minimize impedance mismatches.

While the invention has been described in conjunction with specific embodiments, it is evident that many alternatives, modifications, permutations and variations will become apparent to those of ordinary skill in the art in light of the foregoing description. Accordingly, the present invention is intended to embrace all such alternatives, modifications and variations as fall within the scope of the appended claims.

What is claimed is:

1. An electrical relay comprising:

a first electrical contact, having a wettable surface;

a second electrical contact with a wettable surface, at least partially lining the cavity in the second electrical contact to form a liquid well;

a well-support structure in close proximity to the first and second electrical contacts, the well-support structure having a liquid well formed within it;

a first conducting liquid volume in wetted contact with the first electrical contact;

a second conducting liquid volume in the liquid well in wetted contact with the second electrical contact; and an actuator having a rest position at least partially within the liquid well;

wherein expansion of the actuator decreases the volume of the liquid well and displaces the second conducting liquid volume, thereby causing the first and second conducting liquid volumes to coalesce and complete an electrical circuit between the first and second electrical contacts, and contraction of the actuator increases the volume of the liquid well, thereby causing the first and second conducting liquid volumes to separate and break the electrical circuit.

2. An electrical relay in accordance with claim 1, further comprising:

a first signal conductor, electrically coupled to the first electrical contact; and a second signal conductor, electrically coupled to the second electrical contact.

3. An electrical relay in accordance with claim 2, wherein the second signal conductor provides the well-support structure.

4. An electrical relay in accordance with claim 2, further comprising:

a ground shield, encircling the first and second electrical contacts and the first and second signal conductors;

a first dielectric layer positioned between the ground shield and the first signal conductor, the first dielectric layer electrically insulating the ground shield from the first signal conductor; and a second dielectric layer positioned between the ground shield and the second signal conductor, the second dielectric layer electrically insulating the ground shield from the second signal conductor.

5. An electrical relay in accordance with claim 1, wherein the first electrical contact is attached to the actuator.

6. An electrical relay in accordance with claim 5, wherein expansion of the actuator moves the first electrical contact towards the second electrical contact and contraction of the actuator moves the first electrical contact away from the second electrical contact.

7. An electrical relay in accordance with claim 1, wherein the actuator comprises one of a piezoelectric actuator and a magnetorestrictive actuator.

8. An electrical relay in accordance with claim 1, wherein the first and second conducting liquid volumes are liquid metal volumes.

9. An electrical relay in accordance with claim 1, wherein the first and second conducting liquid volumes are sized such that coalesced volumes remain coalesced when the actuator is returned to its rest position, and separated volumes remain separated when the actuator is returned to its rest position.

10. An electrical relay in accordance with claim 1, further comprising a non-wetting coating partially covering the first electrical contact to prevent migration of the conducting liquid along the first electrical contact.

11. An electrical relay in accordance with claim 1, further comprising:

a circuit substrate supporting electrical connections to the actuator;

a cap layer; and a switching layer positioned between the circuit substrate and the cap layer and having a channel formed therein;

wherein the first and second electrical contacts and the actuator are positioned within the channel.

12. An electrical relay in accordance with claim 11, wherein at least one of the electrical connections to the actuator passes through the circuit substrate.

13. An electrical relay in accordance with claim 11, wherein the electrical connections to the actuator comprise traces deposited on the surface of the circuit substrate.

14. An electrical relay in accordance with claim 11, manufactured by a method of micro-machining.

15. An electrical relay in accordance with claim 11, wherein the cap layer is fabricated from one of ceramic, glass, metal, silicon and polymer.

16. An electrical relay in accordance with claim 11, wherein the circuit substrate is fabricated from one of ceramic, glass and silicon.

* * * * *